US008596605B2

(12) United States Patent
Xie et al.

(10) Patent No.: US 8,596,605 B2
(45) Date of Patent: Dec. 3, 2013

(54) FLOOR THROUGH-PASSAGE MOLDING APPARATUS

(75) Inventors: Yanbo Xie, Guangdong (CN); Ting Xia, Guangdong (CN); Wei Zhang, Guangdong (CN)

(73) Assignee: Shenzshen China Star Optoelectronics Technology Co., Ltd., Guangdong (CN)

( * ) Notice: Subject to any disclaimer, the term of this patent is extended or adjusted under 35 U.S.C. 154(b) by 0 days.

(21) Appl. No.: 12/997,728

(22) PCT Filed: Nov. 26, 2010

(86) PCT No.: PCT/CN2010/079169

§ 371 (c)(1),
(2), (4) Date: Dec. 13, 2010

(87) PCT Pub. No.: WO2012/058832

PCT Pub. Date: May 10, 2012

(65) Prior Publication Data

US 2012/0193508 A1 Aug. 2, 2012

(30) Foreign Application Priority Data

Nov. 4, 2010 (CN) ..... 2010 1 0533803

(51) Int. Cl.
*E04G 15/06* (2006.01)
*B28B 7/28* (2006.01)

(52) U.S. Cl.
CPC ..... *E04G 15/063* (2013.01); *B28B 7/28* (2013.01)
USPC ..... 249/39; 249/175

(58) Field of Classification Search
USPC ..... 52/220.8; 249/39, 175
See application file for complete search history.

(56) References Cited

U.S. PATENT DOCUMENTS 1,746,696 A * 2/1930 Dows ..... 249/177

FOREIGN PATENT DOCUMENTS

| | | | |
|---|---|---|---|
| CN | 2642930 | Y | 9/2004 |
| CN | 1584260 | A | 2/2005 |
| CN | 101812921 | A | 8/2010 |
| CN | 102191860 | A | 9/2011 |
| JP | 11081663 | A | 3/1999 |
| JP | 2000145142 | A | 5/2000 |
| JP | 2001173228 | A | 6/2001 |

* cited by examiner

*Primary Examiner* — Michael Safavi
(74) *Attorney, Agent, or Firm* — Mark M. Friedman

(57) ABSTRACT

The present invention provides a floor through-passage molding apparatus adapted for a floor construction, which comprises a forming sleeve, a first covering plate assembly, a second covering plate assembly and a plurality of retaining assemblies. Said forming sleeve has a sleeve wall defining a hollow channel, a first opening and a second opening. Said first and second covering plate assemblies are respectively disposed on the first and second openings of said forming sleeve. Said plurality of retaining assemblies passes through the hollow channel of said forming sleeve, and are respectively retained with the first and second covering plate assemblies by a plurality of corresponding retaining holes formed on said first and second covering plate assemblies, wherein positions of the plurality of corresponding retaining holes distributed on said first covering plate assembly or said second covering plate assembly jointly define at least one plane.

16 Claims, 4 Drawing Sheets

FLOOR THROUGH-PASSAGE MOLDING APPARATUS

FIELD OF THE INVENTION

The present invention relates to a floor through-passage molding apparatus, and especially to, a floor through-passage molding apparatus having a higher impact-resisting capacity.

BACKGROUND OF THE INVENTION

In a current large building construction such as a manufactory construction, it is essential to adopt a through-passage forming apparatus or molding apparatus on preservation of a space required for each one of the through-passages. After poured into a circumambiency of the through-passage forming apparatus or molding apparatus, the concretes are set to form the through passages treated as ducts, supplying-water pipes or cable passageways, besides each of the concrete floor, simultaneously. In especial, a concrete floor located between a working level and a bottom returning-air passageway level of a high-class clean room needs disposal of the through passages thereon for ventilation. This would result in maintaining a higher ventilating quantity, elongating a length of the through passage and enlarging the through passage diameter, simultaneously, in addition that a thickness of the concrete floor is thickened to raise a bearing capacity of the manufactory floor. However, the elongation of the through-passage length would make a stressed region of the through-passage forming apparatus or molding apparatus against the concretes being widened.

Several conventional technologies, for examples, a Japanese Utility Model Publication No. H5-32586, a Japanese Pat. Publication No. H11-81663 and a Japanese Pat. Publication No. 2000-145142, have provided various through-passage forming apparatus or molding apparatus, most of which structurally and primarily have an upper cover, a lower cover, a hollow standing sleeve and a single retaining assembly. FIG. 1 illustrates an exemplar upon the Japanese Pat. Publication No. 2000-145142, which is explained as following: a hollow standing sleeve 5 has an upper opening and a lower opening both communicated with a hollow space thereof, wherein the lower cover 2 and the upper cover 4 both are formed with an aperture or an inner-threaded hole on a central position thereof. In assembly, said single retaining assembly 3 could be accommodated within the hollow space of the standing sleeve 5. The upper cover 4 is used to cover the upper opening of the standing sleeve 5 and the lower cover 2 is used to cover the lower opening of the standing sleeve 5. Then, by threads and/or an additional nut located on ends of the retaining assembly 3, the two opposite ends of the retaining assembly 3 are respectively up-and-down screwed to the upper and lower cover 4, 2. This leads the lower cover 2, the upper cover 4 and the standing sleeve 5 triple to be integrated. The through-passage forming apparatus or molding apparatus is merely joined in a vertical direction to a horizontal construction molding of the concrete floor by its lower cover 2 or the end of the single retaining assembly 3. However, under a factual construction, the concrete would principally impact the through-passage forming apparatus or molding apparatus along a horizontal direction relative to the apparatus when poured. If the through-passage forming apparatus or molding apparatus is infirmly fastened on the horizontal construction molding of the concrete floor, the impact of the being-poured concrete very readily slants or deforms the through-passage forming apparatus or molding apparatus so that the through passage might be deformed or damaged after the concrete floor is set-to-formed. Additionally, only by respectively screwing the single retaining assembly to the central retaining points of said upper and lower covers 4, 2, the upper and lower covers 4, 2 might easily become slanted or deformed as long as undergoing the pressure and thereby slip in a direction along a sleeve wall of the standing sleeve 5. This eventually invokes the standing sleeve 5 deformed and slanted. Moreover, the upper cover, the lower cover and the retaining assembly would be stripped and removed from the above-mentioned current through-passage forming apparatus or molding apparatus after the formation of the concrete floor, only exception of the standing sleeve which is reserved within the through passage of the concrete floor. This would invoke an annular slit occurring between the sleeve wall of the standing sleeve and a circumference of the through passage wall of the concrete floor and exposed to the outside with a possible dusty precipitation or a straining damage possibly occurring from the through-passage wall undergoing an external force. It is possible happened that the concrete floor compresses the standing sleeve since stressed under the construction.

Accordingly, it is essential to develop a through-passage molding apparatus capable of reinforcing its entire structure to resolve the aforementioned problem.

SUMMARY OF THE INVENTION

To eliminate the drawbacks of the aforementioned prior art, a primary objective of the present invention is to provide a floor through-passage molding apparatus which reinforces the entire structure thereof by a plurality of retaining assemblies of which retaining positions are arranged in coplanar arrangements, whereby during a process of forming a concrete floor through passage, a higher impact-resisting capacity is provided to prevent the floor through-passage molding apparatus from being deformed or slanted.

To achieve the aforementioned invention objective, a preferred embodiment of the present invention provides a floor through-passage molding apparatus adapted for a floor construction, which primarily and structurally comprises: a forming sleeve, a first covering plate assembly, a second covering plate assembly and a plurality of retaining assemblies.

Said forming sleeve has a sleeve wall defining a hollow channel, a first opening and a second opening, wherein the first opening and the second opening are communicated with each other via said hollow channel.

Said first covering plate assembly used with disposal on the first opening of said forming sleeve, has a supporting rack and a shielding plate located on said supporting rack, wherein said shielding plate further includes a central caved portion and an outer circular section surrounding said central caved portion. A region measurement defined within said outer circular section is larger than a region measurement defined by a bottom of said central caved portion. Said supporting rack further includes an annular portion, a seat portion and a plurality of ribs. Two ends of each of said plurality of ribs are radially connected to said annular portion and said seat portion, respectively. Said seat portion is used to support said shielding plate. Said annular portion surrounds and defines a central region measurement, and said shielding plate occupies between 20% and 100% of the central region measurement.

Said first covering plate assembly is defined with a plurality of corresponding retaining holes which includes a plurality of first retaining holes distributed on either the outer circular section or the central caved portion of the shielding plate in positions jointly defining a first plane, and a plurality of second retaining holes distributed on either the seat portion or the plurality of ribs of the supporting rack in corresponding to the distributed positions of the plurality of first retaining holes of said shielding plate. The distributed positions of said plurality of second retaining holes jointly define a second plane.

Said second covering plate assembly used with disposal on the second opening of said forming sleeve, is defined with a plurality of corresponding retaining holes, which includes a plurality of third retaining holes distributed on the second covering plate assembly in positions jointly defining a third plane.

The first plane, the second plane and the third plane respectively defined by the distributed positions among the plurality of first retaining holes, the second retaining holes and the third retaining holes all are a polygon, e.g. a triangle, a quadrangle, a pentagon and so on. In another embodiment, said polygon is an equilateral polygon, e.g. an equilateral triangle, an equilateral quadrangle and an equilateral pentagon and so on.

Said plurality of retaining assemblies pass through the hollow channel of said forming sleeve, each of which has outer threads formed on two opposite ends thereof. The outer thread of each of the ends is used to match a corresponding nut, wherein the two opposite ends of each of the retaining assemblies respectively pass through the plurality of first retaining holes, the second retaining holes and the third retaining holes of the first covering plate assembly and the second covering plate assembly. By further screwing the corresponding nut, the two opposite ends of said plurality of retaining assemblies are respectively retained to the plurality of corresponding retaining holes of the first covering plate assembly and the second covering plate assembly. By retaining the two opposite ends of said plurality of retaining assemblies to the plurality of first retaining holes, the second retaining holes and the third retaining holes, a plurality of retaining positions of said plurality of retaining assemblies can be arranged in a coplanar arrangement on each plane of the first plane of the shielding plate, the second planes of the supporting rack in the first covering plate assembly and the third plane of the second covering plate assembly to constitute a multi-level and multi-position retaining for reinforcing the entire structure of the apparatus. During a process of forming a concrete floor through passage, a higher impact-resisting capacity can be provided, especially in providing the floor through-passage molding apparatus with a horizontal firm assembly so as to prevent the floor through-passage molding apparatus from being deformed or slanted.

To explicitly realize the aforementioned context of the present invention, the following paragraphs citing various preferred embodiments by reference to the following detailed description, when taken in conjunction with the accompanying drawings as followings.

DETAILED DESCRIPTION OF THE PREFERRED EMBODIMENT

In order to make the illustration of the present invention more explicit and complete, the following description is stated with reference to illustrations of different figures where the same numeral reference is used to denote the same or similar component.

Figure 1:
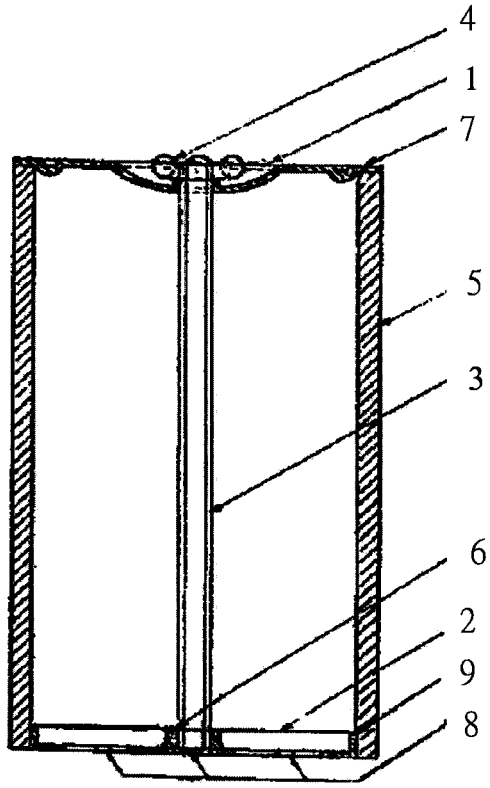
FIG. 1 depicts a cross-sectional view diagram of a conventional floor through-passage molding apparatus.
Figure 2:
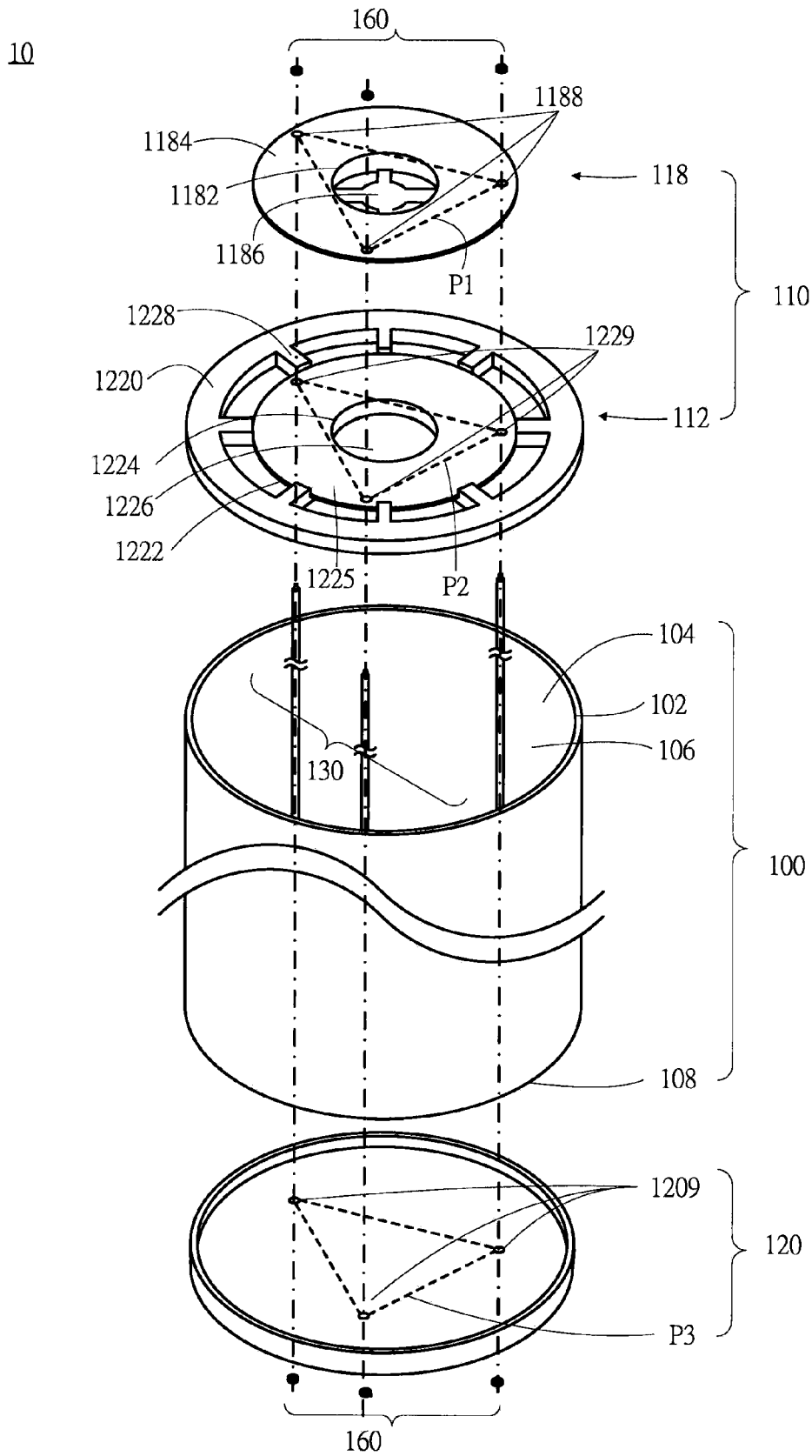
FIG. 2 depicts an up-to-down component-exploded diagram of a floor through-passage molding apparatus according to the first preferred embodiment of the present invention.
Figure 3:
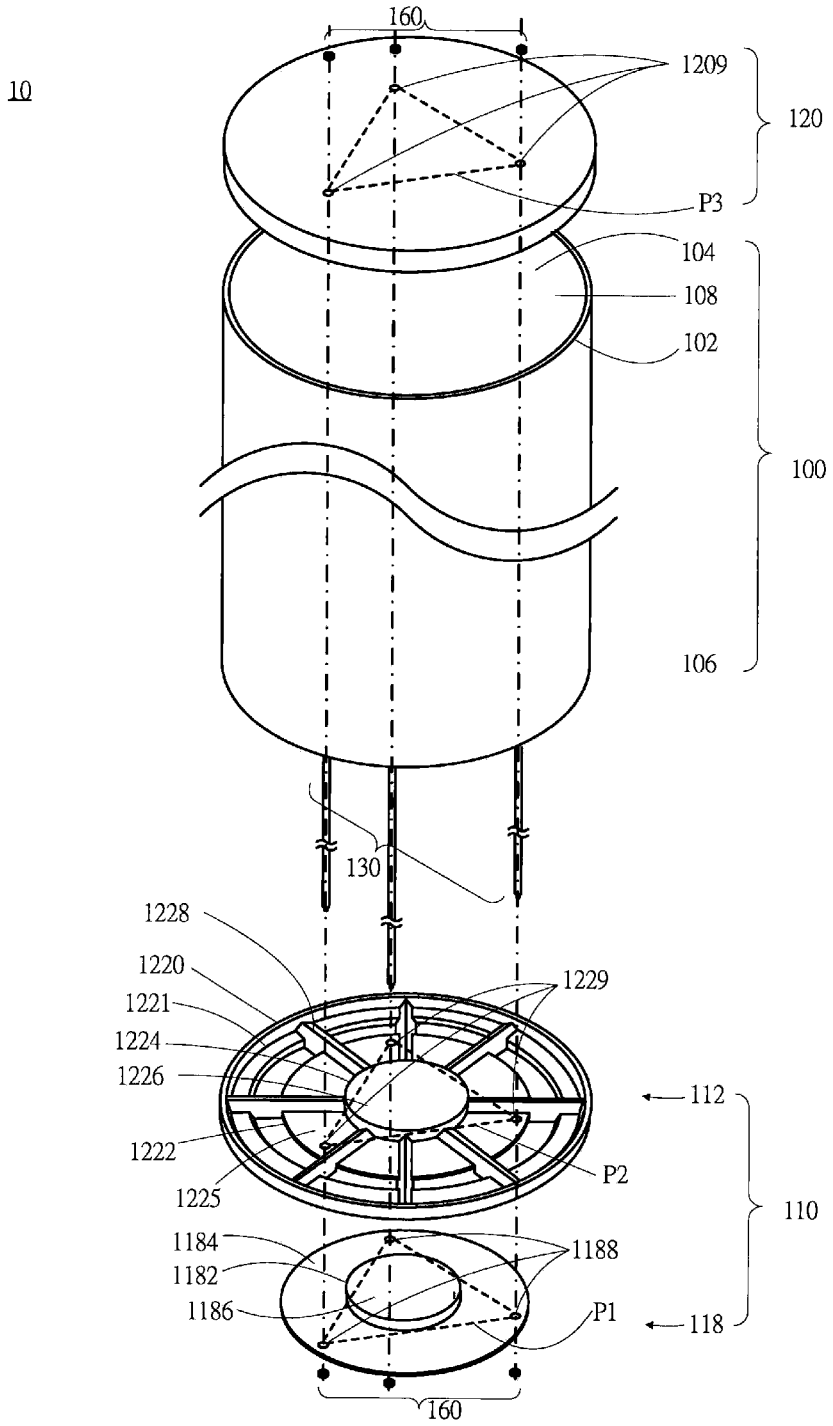
FIG. 3 depicts a down-to-up component-exploded diagram of the floor through-passage molding apparatus according to the first preferred embodiment of the present invention.

FIGS. 2 and 3 depict a floor through-passage molding apparatus 10 according to a first preferred embodiment of the present invention adapted for a floor construction structured in concretes, which primarily and structurally comprises: a forming sleeve 100, a first covering plate assembly 110, a second covering plate assembly 120 and three retaining assemblies 130.

Said forming sleeve 100 can be made of various types of metallic or plastic material and is used for being embedded within the floor construction. By pouring the concrete to a circumambiency of the forming sleeve 100, the set concrete will forms a plurality of required through passages, each of which is treated as ducts, supplying-water pipes or cable passageways. Said forming sleeve 100 has a sleeve wall 102 defining a hollow channel 104, a first opening 106 and a second opening 108. Said first opening 106 and said second opening 108 are respectively located on two opposite ends of said forming sleeve 100 and communicated with each other via said channel 104.

Said first covering plate assembly 110 is used with disposal on the first opening 106 of said forming sleeve 100, and has a supporting rack 112 and a shielding plate 118 located on said supporting rack 112.

Said shielding plate 118 is made of a metal disk in integral. The shielding plate 118 includes a first central caved portion 1182 located on the center of said shielding plate 118 and a ring-like first outer circular section 1184 surrounding the circumference of the said first central caved portion 1182, wherein said first central caved portion 1182 has a planar bottom 1186 which is lowered relative to a surface of the first outer circular section 1184 so as to a height drop, and said bottom 1186 is formed with crossed bulges on the center thereof, as reinforcing the structure of said shielding plate 118. In this embodiment, a region measurement surrounded and defined by said first outer circular section 1184 is larger than a region measurement defined by the bottom 1186 of said first central caved portion 1182 so that a retained area among the shielding plate 118 and said plurality of retaining assemblies 130 can be extended. Therefore, this makes the first outer circular section 1184 of said shielding plate 118 forming three first retaining holes 1188 (e.g. a through hole or an inner-threaded hole) thereon. Positions of said three first retaining holes 1188 distributed on the first outer circular section 1184 can jointly define a first plane "P1" (as indicated in dotted lines in FIG. 2).

In another embodiment, said three first retaining holes 1188 are distributed on the first central caved portion 1182 of the shielding plate 118 so that the positions of said three first retaining holes 1188 distributed on the first central caved portion 1182 jointly define a first plane "P1".

Said supporting rack 112, which adopts a flexible material in integral, as made of an injection-molding plastic, includes an annular portion 1220, a seat portion 1222 and a plurality of ribs 1228, wherein said annular portion 1220 is located on the outset circumference of supporting rack 112 and constituted by an annular vertical wall and an annular horizontal wall. An annular recess 1221 with an L-shaped cross section (as indicated in FIG. 3) is defined between said annular vertical wall and annular horizontal wall. Said seat portion 1222 located on the center of the supporting rack 112, is used to accommodate and support said shielding plate 118 and includes a round-shaped second central caved portion 1224 located on the center of the seat portion 1222, and an annular second outer circular section 1225 surrounding the circumference of said second central caved portion 1224. The second outer circular section 1225 and the second central caved portion 1224 of said seat portion 1222 all can be matched with the first outer circular section 1184 and the first central caved portion 1182 of said shielding plate 118 in dimensions and shapes. For example, the second central caved portion 1224 has a planar bottom 1226 as well which is lowered relative to a surface of the second outer circular section 1225 in a height drop. The height drop is the same as the bottom 1186 of the first central caved portion 1182 of said shielding plate 118. This facilitates the first central caved portion 1182 of said shielding plate 118 being fully accommodated within the second central caved portion 1224 of the supporting rack 112.

As illustrated in FIGS. 2 and 3, the plurality of ribs 1228 are spaced apart from each other, each of which has an end radially connected to the annular vertical wall and the annular horizontal wall of the above-mentioned annular portion 1220, and the other opposite end reversely connected to the edges of the bottom 1226 of the second central caved portion 1224 and the second outer circular section 1225 of said seat portion 1222. Thus, said plurality of ribs 1228 are capable of reinforcing structures along a horizontal direction relative to the annular portion 1220. In special, when said supporting rack 112 is disposed on the first opening 106 of the forming sleeve 100, the plurality of ribs 1228 can be utilized to prevent the forming sleeve 100 from being deformed.

In this embodiment, a central region measurement surrounded and defined by the annular portion 1220 of said supporting rack 112, wherein said shielding plate 118 occupies between 20% and 100% of said central region measurement so as to extend the retained area among the shielding plate 118 and said plurality of retaining assemblies 130. The second outer circular section 1225 of said supporting rack 112 forms three second retaining holes 1229 (e.g. a through hole or an inner-threaded hole) thereon, with respectively corresponding to the distributed positions of the three first retaining holes 1188 of the shielding plate 118, whereby the positions of said three second retaining holes 1229 distributed on the second outer circular section 1225 can jointly define a second plane "P2" (as indicated in dotted lines in FIG. 2).

In another embodiment, said three second retaining holes 1229 are distributed on the second central caved portion 1224 of the supporting rack 112, with respectively corresponding to the distributed positions of the three first retaining holes 1188 of said shielding plate 118, so that positions of said three second retaining holes 1229 distributed on the second central caved portion 1224 jointly define a second plane "P2".

In another embodiment, if the second outer circular section 1225 of said seat portion 1222 is dimensioned smaller than the first outer circular section 1184 of said shielding plate 118, said three second retaining holes 1229 may be distributed on the plurality of ribs 1228 of the supporting rack 112, with respectively corresponding to the distributed positions of the three first retaining holes 1188 of said shielding plate 118, so that the distributed positions of said three second retaining holes 1229 jointly define a second plane "P2".

Said second covering plate assembly 120 used with disposal on the second opening 108 of said forming sleeve 100 forms three third retaining holes 1209 (e.g. a through hole or an inner-threaded hole) which are distributed on the second covering plate assembly 120. Distributed positions of said three third retaining holes 1209 jointly define a third plane "P3".

In this embodiment, each of the first plane "P1", the second plane "P2", and the third plane "P3" defined by the distributed positions of said three first retaining holes 1188, said three second retaining holes 1229 and said three third retaining holes 1209 form a polygon such as a triangle. These polygons constituted by said three planes "P1", "P2" and "P3" have the same or similar dimensions and shapes but may have the different dimensions and/or shapes in another embodiment.

In another embodiment, the first plane "P1", the second plane "P2", and the third plane "P3" defined by the distributed positions of said plurality of first retaining holes 1188, said plurality of second retaining holes 1229 and said plurality of third retaining holes 1209 also can constitute a quadrangle, a pentagon or more than the pentagon.

In another embodiment, said polygon may be an equilateral polygon. For example, an equilateral triangle, an equilateral quadrangle, an equilateral pentagon or more than the equilateral pentagon.

Said three long rod-like retaining assemblies 130 are used to pass through the hollow channel 104 of said forming sleeve 10, each of which has two opposite ends respectively forming an outer threads to extends outside the first opening 106 and the second opening 108 of the forming sleeve 100, wherein the outer thread of each of the ends is used to match a corresponding nut 160.

Figure 4:
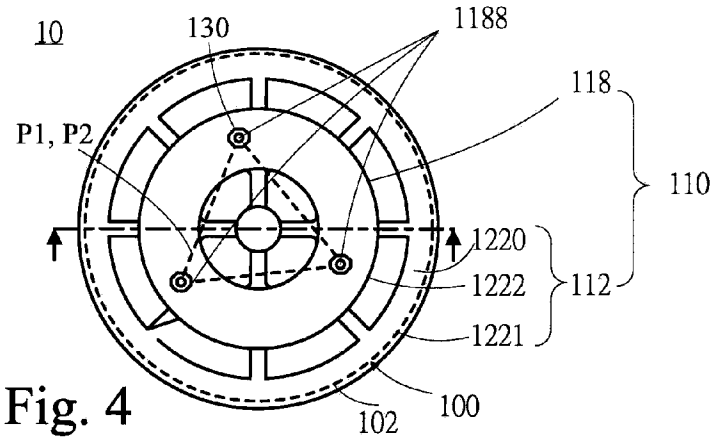
FIG. 4 depicts a top-view assembled diagram of the floor through-passage molding apparatus according to the first preferred embodiment of the present invention.
Figure 5:
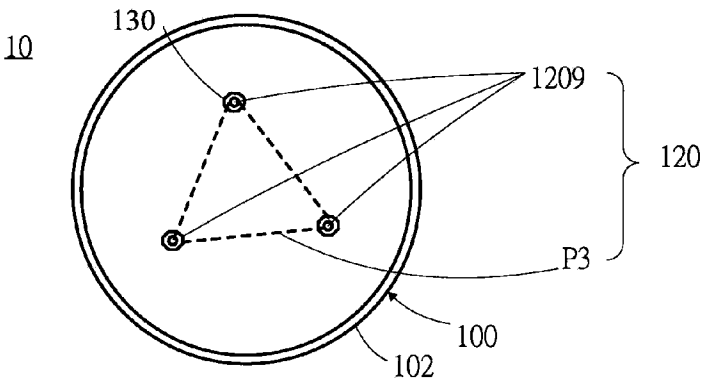
FIG. 5 depicts a bottom-view assembled diagram of the floor through-passage molding apparatus according to the first preferred embodiment of the present invention.
Figure 6:
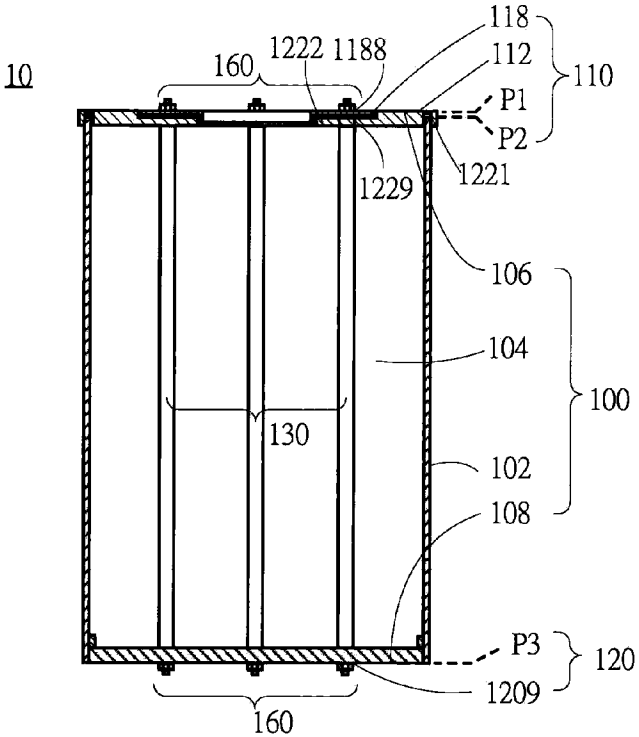
FIG. 6 depicts a cross-sectional view diagram of the floor through-passage molding apparatus according to the illustration of FIG. 4.

In assembly of the floor through-passage molding apparatus 10, as shown in FIGS. 4 and 6, each retaining assembly 130 upwardly passes through the corresponding first retaining hole 1188 of the shielding plate 118 and the corresponding second retaining hole 1229 of the supporting rack 112 of the first covering plate assembly 110 in turns by the end. This makes the shielding plate 118 just arranged on the center of the seat portion 1222 of the supporting rack 112 and said supporting rack 112 disposed on the first opening 106 of the forming sleeve 100, wherein the annular recess 1221 of the annular portion 1220 of the supporting rack 112 is slipped over the top of the sleeve wall 102 of the forming sleeve 100. By further screwing the ends of said retaining assemblies 130 to the corresponding nuts, the ends of said retaining assemblies 130 are retained within the plurality of corresponding retaining holes 1188, 1229 of the first covering plate assembly 110. Besides, as shown in FIGS. 5 and 6, the other opposite ends of said retaining assemblies 130 downwardly pass through the corresponding third retaining holes 1209 of the second covering plate assembly 120. This makes said second covering plate assembly 120 disposed on the second opening 108 of the forming sleeve 100. By further screwing the other opposite ends of said retaining assemblies 130 to the corresponding nuts 160, the other opposite ends of said retaining assemblies 130 are retained within the corresponding retaining holes 1209 of the second covering plate assembly 120. The result of the assembly is as shown in FIG. 6 where the shielding plate 118 and the supporting rack 112 of the first covering plate assembly 110, the second covering plate assembly 120 and the forming sleeve 100 can be firmly assembled together.

As shown in FIG. 6, by retaining the opposite ends of said three retaining assemblies 130 within said three first retaining holes 1188, said three second retaining holes 1229 and said third retaining holes 1209, the plurality of retaining positions of said three retaining assemblies 130 can be arranged in a coplanar arrangement on each of the first plane "P1" and the second plane "P2" of the first covering plate assembly 110 and the third plane "P3" of the second covering plate assembly 120. This constitutes a multi-level and multi-position retaining and thereby reinforces the entire structure of the apparatus. During a process of forming a concrete floor through passage, a higher impact-resisting capacity can be provided, especially in providing the floor through-passage molding apparatus 10 with a horizontal firm assembly so as to prevent the floor through-passage molding apparatus from being deformed or slanted.

In another embodiment, the amount of said retaining assemblies 130 does not limit to three but can match a first polygonal plane "P1", a second polygonal plane "P2" and a third polygonal plane "P3" defined by the distributed positions of the plurality of first retaining holes 1188, the plurality of second retaining holes 1229 and the plurality of third retaining holes 1209 with usage of more than the three retaining assemblies 130.

In inclusion, the floor through-passage molding apparatus of the present invention is capable of providing a higher impact-resisting capacity to prevent the floor through-passage molding apparatus from being deformed or slanted, during the process of forming the concrete floor through passage, especially in a horizontal direction where the being-poured concrete impacts.

What is claimed is:

1. A floor through-passage molding apparatus adapted for a floor construction, comprising:

a forming sleeve having a sleeve wall defining a hollow channel, a first opening and a second opening, said first opening and said second opening being communicated with each other via said hollow channel;

a first covering plate assembly, disposed on the first opening of said forming sleeve;

a second covering plate assembly, disposed on the second opening of said forming sleeve; and characterized in that said floor through-passage molding apparatus further comprises:

said first covering plate assembly having a supporting rack and a shielding plate; and a plurality of retaining assemblies each extended through the hollow channel and having two opposite ends respectively retained within a plurality of corresponding retaining holes which are respectively formed on the supporting rack, the shielding plate and the second covering plate assembly, wherein positions of the corresponding retaining holes formed on said supporting rack jointly define a first plane, positions of the corresponding retaining holes formed on said shielding plate jointly define a second plane, and positions of the corresponding retaining holes formed on said second covering plate assembly jointly define a third plane so as to constitute a multi-level and multi-position retaining for said plurality of retaining assemblies.

2. The floor through-passage molding apparatus according to said claim 1, characterized in that the first plane, the second plane and the third plane are a polygon.

3. The floor through-passage molding apparatus according to said claim 2, characterized in that said polygon is an equilateral polygon.

4. The floor through-passage molding apparatus according to said claim 1, characterized in that said plurality of retaining assemblies are arranged in a coplanar arrangement on each of the first plane, the second plane and the third plan.

5. A floor through-passage molding apparatus adapted for a floor construction, comprising:

a forming sleeve, having a sleeve wall defining a hollow channel, a first opening and a second opening, said first opening and said second opening being communicated with each other via said hollow channel;

a first covering plate assembly, disposed on the first opening of said forming sleeve;

a second covering plate assembly, disposed on the second opening of said forming sleeve; and characterized in that said floor through-passage molding apparatus further comprises:

said first covering plate assembly having a supporting rack and a shielding plate; and a plurality of retaining assemblies each extended through the hollow channel of said forming sleeve and having two opposite ends respectively retained with the first covering plate assembly and the second covering plate assembly via a plurality of corresponding retaining holes which are respectively formed on the supporting rack, the shielding plate and said second covering plate assembly, wherein the plurality of corresponding retaining holes comprises a plurality of first retaining holes formed on said shielding plate, a plurality of second retaining holes formed on said supporting rack, and a plurality of third retaining holes formed on the second covering plate assembly, and positions of the plurality of first retaining holes formed on said shielding plate jointly define a first plane, positions of the plurality of second retaining holes distributed on said supporting rack jointly define a second plane, and positions of the plurality of third retaining holes distributed on said second covering plate assembly jointly define a third plane.

6. The floor through-passage molding apparatus according to claim 5, characterized in that each of the first, second and third planes defined by the respective positions of each of the plurality of first retaining holes, the plurality of second retaining holes and the plurality of third retaining holes is a polygon.

7. The floor through-passage molding apparatus according to said claim 6, characterized in that said polygon is an equilateral polygon.

8. The floor through-passage molding apparatus according to said claim 5, characterized in that the two opposite ends of each of said plurality of retaining assemblies form outer threads, each of which is used to match a corresponding nut, wherein by screwing the corresponding nuts, the two opposite ends of said plurality of retaining assemblies are respectively retained to the plurality of corresponding retaining holes of the first covering plate assembly and the second covering plate assembly.

9. The floor through-passage molding apparatus according to said claim 5, characterized in that said shielding plate further comprises a central caved portion and an outer circular section surrounding said central caved portion, wherein said plurality of first retaining holes are distributed on either the outer circular section or the central caved portion of the shielding plate.

10. The floor through-passage molding apparatus according to said claim 9, characterized in that a region measurement defined by said outer circular section is larger than a region measurement defined by a bottom of said central caved portion.

11. The floor through-passage molding apparatus according to said claim 5, characterized in that said supporting rack further comprises an annular portion, a seat portion and a plurality of ribs, and said plurality of ribs are respectively radially connected to said annular portion and seat portion, and said seat portion is used to support said shielding plate, wherein said plurality of second retaining holes are distributed on either the seat portion or the plurality of ribs of the supporting rack.

12. The floor through-passage molding apparatus according to said claim 11, characterized in that said annular portion surrounds and defines a central region measurement, and said shielding plate occupies over 20% of said central region measurement.

13. A floor through-passage molding apparatus adapted for a floor construction, comprising:

a forming sleeve, having a sleeve wall defining a hollow channel, a first opening and a second opening, said first opening and said second opening being communicated with each other via said hollow channel;

a first covering plate assembly, disposed on the first opening of said forming sleeve and having a supporting rack and a shielding plate located on said supporting rack, wherein said supporting rack includes an annular portion;

a second covering plate assembly, disposed on the second opening of said forming sleeve; and characterized in that said floor through-passage molding apparatus further comprises:

said first covering plate assembly having a supporting rack and a shielding plate; and a plurality of retaining assemblies each extended through the hollow channel of said forming sleeve and having two opposite ends respectively retained within a plurality of corresponding retaining holes which are respectively formed on the supporting rack, the shielding plate and the second covering plate assembly, the plurality of corresponding retaining holes comprises a plurality of first retaining holes formed on said shielding plate, a plurality of second retaining holes formed on said supporting rack, and a plurality of third retaining holes formed on the second covering plate assembly, and positions of the plurality of first retaining holes formed on said shielding plate jointly define a first plane, positions of the plurality of second retaining holes distributed on said supporting rack jointly define a second plane , and positions of the plurality of third retaining holes distributed on said second covering plate assembly jointly define a third plane, wherein the annular portion of said supporting rack surrounds and defines a central region measurement and said shielding plate occupies over 20% of said central region measurement.

14. The floor through-passage molding apparatus according to said claim 13, characterized in that said shielding plate further comprises a central caved portion and an outer circular section surrounding said central caved portion, and the plurality of first retaining holes of said shielding plate are distributed on either the outer circular section or the central caved portion.

15. The floor through-passage molding apparatus according to said claim 14, characterized in that a region measurement defined by said outer circular section is larger than a region measurement defined by a bottom of said central caved portion.

16. The floor through-passage molding apparatus according to said claim 13, characterized in that said supporting rack further comprises a seat portion and a plurality of ribs, and said plurality of ribs are respectively radially connected to said annular portion and said seat portion, and said seat portion is used to support said shielding plate, wherein the plurality of corresponding retaining holes of said supporting rack are distributed on either the seat portion or the plurality of ribs.

* * * * *

UNITED STATES PATENT AND TRADEMARK OFFICE

CERTIFICATE OF CORRECTION

PATENT NO. : 8,596,605 B2
APPLICATION NO. : 12/997728
DATED : December 3, 2013
INVENTOR(S) : Yanbo Xie et al.

It is certified that error appears in the above-identified patent and that said Letters Patent is hereby corrected as shown below:

Title page

Item (73) should be corrected as follows:

Change

-- Shenzshen China Star Optoelectronics Technology Co., Ltd. -- to

"Shenzhen China Star Optoelectronics Technology Co., Ltd"

Signed and Sealed this
Eleventh Day of February, 2014

Michelle K. Lee

Michelle K. Lee
*Deputy Director of the United States Patent and Trademark Office*